US005642186A

United States Patent [19]

Michlin et al.

[11] Patent Number: 5,642,186

[45] Date of Patent: Jun. 24, 1997

[54] SHIM-SEAL DEVICE IN ROTATOR ASSEMBLY OF TONER HOPPER

[75] Inventors: Steven Bruce Michlin, 5310 Bentley Suite 105, West Bloomfield, Mich. 48322; Randall Felix Sell, Buffalo, N.Y.

[73] Assignee: Steven Bruce Michlin, West Bloomfield, Mich.

[21] Appl. No.: 366,675

[22] Filed: Dec. 30, 1994

[51] Int. Cl.[6] ..... G03G 15/00; G03G 15/08

[52] U.S. Cl. ..... 399/107; 399/262

[58] Field of Search ..... 355/200, 210, 355/215, 260

[56] References Cited

U.S. PATENT DOCUMENTS 4,449,810 5/1984 Ikesue et al. ..... 355/260 X 4,721,982 1/1988 Ueda ..... 355/253 X 5,166,731 11/1992 Aimoto et al. ..... 355/215

5,296,902 3/1994 Michlin ..... 355/260

*Primary Examiner*—Fred L. Braun

[57] ABSTRACT

An improved gasket device for a bushing which drives a stir-rod has been developed for use in a toner hopper. In one embodiment, the improved gasket uses a crush-resistant material, such as velvet or felt, laminated on a resilient material such as foam tape. The crush-resistant material prevents permanent reduction in the thickness of the gasket by absorbing compressive forces. In a second embodiment, an incompressible shim, for example a steel or plastic shim spaces the felt gasket from the part of the bushing extending from the toner hopper. This tightens the attachment of the bushing to the toner hopper and keeps the felt gasket firmly against the wall of the toner hopper.

28 Claims, 2 Drawing Sheets

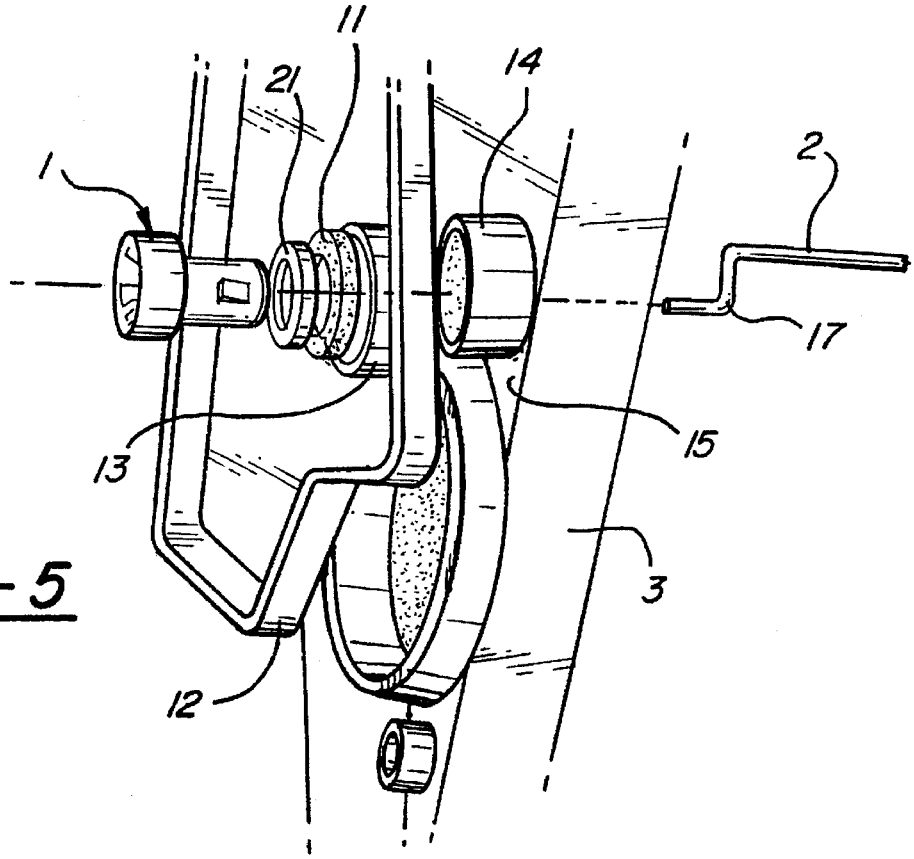
FIG - 5
FIG - 6
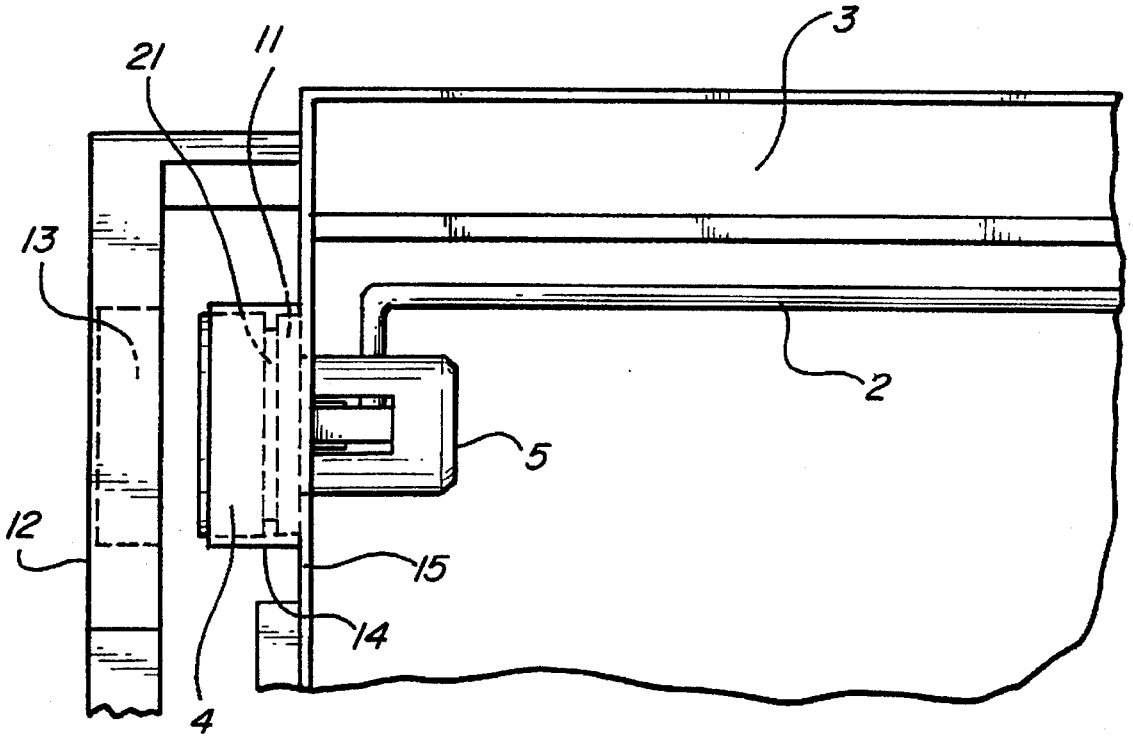

SHIM-SEAL DEVICE IN ROTATOR ASSEMBLY OF TONER HOPPER

BACKGROUND OF THE INVENTION

This invention relates to solving leakage problems in toner hoppers used in Xerography and more specifically in the toner cartridge remanufacturing industry. This includes copiers, laser printers and facsimile machines.

CANON has designed an all-in-one cartridge as in U.S. Pat. No. 4,975,744, issued Dec 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1994 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum" the SX cartridge would last for around three cartridge remanufacturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartrides with longer cycles, so component improvements are significant. Therefore, avoiding natural problems with prevention means must also be implemented for cartridges of longer life both in longer cycle times and greater number of cycles.

In 1992, the EX printer, otherwise known as the Series 4, and its special toner cartridge were introduced. Eventually the Series 4+ printer was introduced in 1994, using the same toner cartridge. The toner hopper of the EX Series-4/4+ toner cartridge has a time-generated flaw. After 2000 to 8000 pages are printed, a leakage tends to begin. The cartridge was designed by the manufacturer to last for only 6000 pages. Every component has a wear-life. Whether the failure was intentional or by accident on the part of the OEM manufacturer, the wear-life-related flaw occurs. It is assumed that the flaw was by accident on the part of the OEM manufacturer, and since 1992, they and the entire toner cartridge remanufacturing industry were unaware of this flaw and how to fix it.

People in the toner cartridge industry could never figure what the cause of the leakage was. Rumor in the industry was that the leakage was caused by a poor ultrasonic weld in the toner hopper, where the toner hopper is joined into 2 parts, where the heat seal is attached. According to the misinformation, the poor ultrasonic weld caused a toner leakage through the seam where the 2 portions of the toner hopper join, thus causing toner leakage. Applicants have found otherwise, have found the actual true cause of the leakage, and have, therefore been able to find a solution to the problem.

The EX series-4 toner cartridge has a white plastic bushing which is inserted through a side wall of the toner hopper for connection to a toner stir-rod inside the toner hopper. The plastic bushing is driven by the imaging machine through a reducing gearbox in the cartridge such that it rotates the stir-rod to prevent the toner from lumping and to keep the toner mixed within the hopper. The bushing has a portion which remains outside the hopper, and a felt gasket pinched between this portion and the side wall of the hopper is supposed to prevent toner from leaking out of the hopper at the location of the bushing.

Toner cartridge technicians have been trying to figure out why the cartridge leaks. Applicants have done extensive research and testing on this problem. To the best of applicants' knowledge, nobody else in the cartridge remanufacturing industry completely understands the problem or has developed a soulution.

It is harder for a gasket to seal a moving part than a stationary part. The felt gasket compresses over time and becomes permanently thinner or deformed. A need exists for an inexpensive gasket which retains its sealing properties for a long period of time and keeps the connection between the bushing and hopper tight so the bushing doesn't wobble. Furthermore, a need exists for an addition to the old used gasket to make it last a long time.

A co-inventer of this application has a U.S. Pat. No. 5,296,902, granted Mar. 22, 1994, which discloses a sealing material for replacing the felt-like seals at the ends of the feed roller on a toner cartridge assembly. The sealing material is a crush-resistant velvet (polyester) or felt attached to a foam backing. The description of that sealing material is hereby incorporated by reference into this application.

SUMMARY OF THE INVENTION

Accordingly, it is an object of this invention to prevent toner leakage at the location where the plastic bushing which drives the toner stir-rod is attached on the toner hopper wall.

A further object of this invention is to prevent the toner stir-rod from warping due to loosening and wobbling of the plastic bushing.

Another object of this invention is to provide an improved gasket for the bushing which has a longer useful life.

In carring out this invention in the illustrative embodiment thereof, an incompressible shim, such as a steel shim, is placed between the part of the plastic bushing which extends from the toner hopper and the felt gasket. The shim makes sure the gasket remains pressed, and therefore, sealed against the toner hopper, providing improved protection against toner leakage. The shim, by taking up space between the bushing and gasket, keeps the connection between the bushing and hopper tight, reducing the tendency of the bushing to loosen, leak or wobble. By giving the felt gasket less room or chance to thin, the shim enables the gasket to retain its sealing properties for a much longer period of time.

In another embodiment, the felt gasket is replaced with a crush-resistant material such as velvet, polyester or felt laminated with a resilient material such as a foam or foam tape. The crush-resistant material provides a longer-lasting seal because the resilient material absorbs the compressive forces and allows a thicker gasket and will maintain a seal when the crush-resistant material eventually compresses.

In another embodiment, the incompressible shim presses tightly on a foam or foam tape. The foam or foam tape maintains resiliency while the shim provides a constantly tight fitting. The incompressible shim may be like the other shims of this invention such as metal or plastic.

BRIEF DESCRIPTION OF THE DRAWINGS

This invention, together with other objects, features, aspects and advantages thereof, will be more clearly understood from the following description, considered in conjunction with the accompanying drawings.

FIG. 5 demonstrates how a bushing and improved gasket are attached to a toner hopper.

FIG. 6 illustrates how an improved gasket tightens the bushing attachment to a toner hopper and seals the hopper.

COMPLETE DESCRIPTION OF THE PREFERRED EMBODIMENT

Figure 1:
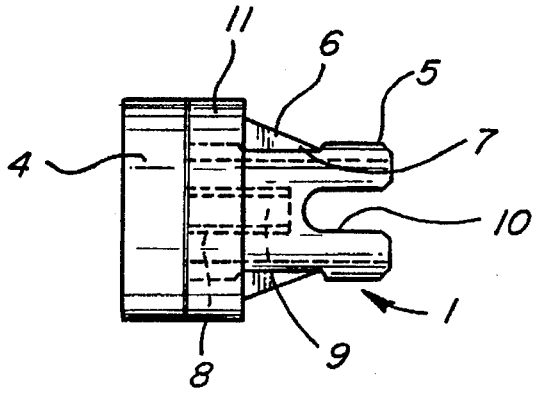
FIG - 1 PRIOR ART
FIG. 1 shows a prior art bushing and gasket, enlarged for clarity.
Figure 2:
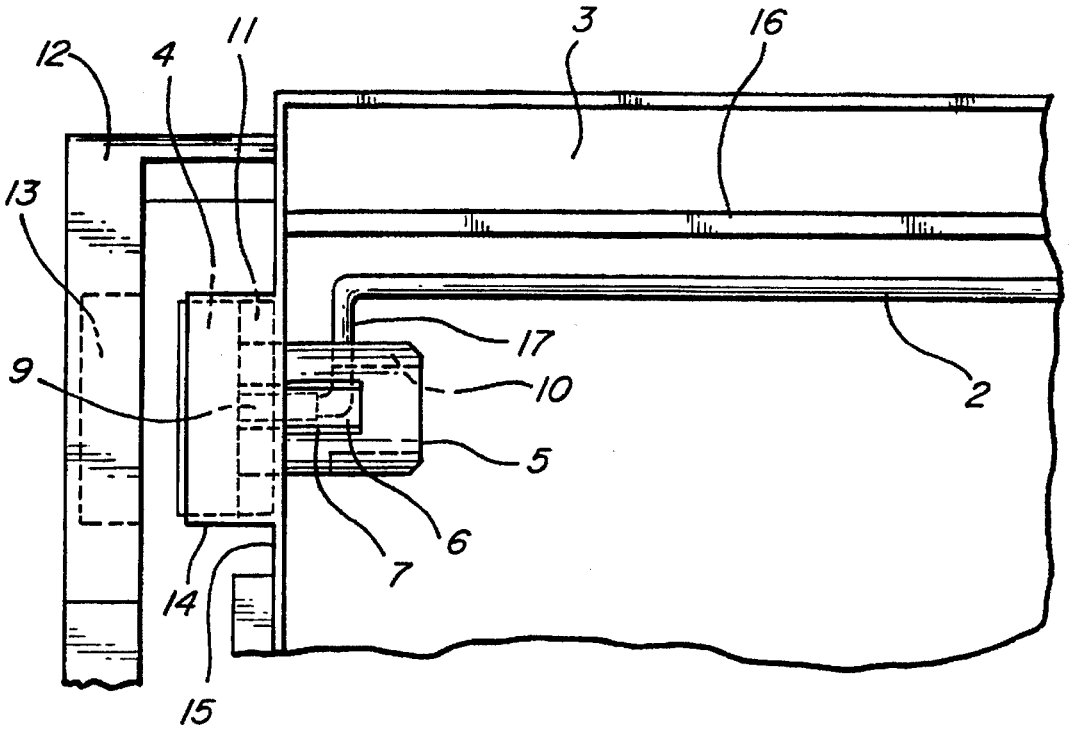
FIG - 2 PRIOR ART
FIG. 2 illustrates how the prior art bushing and gasket are used on a toner hopper.

Referring to FIG. 1, a prior art white plastic bushing 1 used in a toner hopper of a toner cartridge assembly for printers, copiers and facsimile machines is shown. As illustrated in FIG. 2, the bushing 1 is used to rotate a stir-rod 2 located within the toner hopper 3. The metal stir-rod 2 is sealed within the toner hopper 3 and rotates as the cartridge assembly prints. The stir-rod 2 keeps the toner from lumping and keeps the toner mixed.

The components are shown enlarged for clarity. The bushing 1 has a larger diameter (about five-eighths of an inch) first part 4 and a smaller diameter (about three-eighths of an inch) second part 5. The first part 4 is about one-quarter of an inch long and the second part 5 is about nine-sixteenths of an inch long. The second part 5 has two diametrically opposed prongs 6 extending from recesses 7. The spring-loaded prongs 6 are designed to press flat into the recesses 7 and then to snap outward from the second part 5 to lock the plastic bushing 1 in position on the toner hopper 3.

The second part 5 of the bushing 1 is basically hollow except for a small diameter (approximately one-eighth of an inch) cylindrical portion 8 with an inside diameter or cavity 9 sized to receive the stir-rod 2. There are two symmetrical openings 10 at the end of the second part 5 opposite the first part 4. A felt gasket 11 is installed on the second part 5 between the spring-loaded prongs 6 and the first part 4. The felt gasket 11 has an inside diameter approximately equal to the diameter of the second part 5 of the bushing 1 and an outside diameter approximately equal to the diameter of the first part 4. The felt gasket 11 has an uncompressed thickness slightly smaller than the distance between the prongs 6 and the first part 4 of the bushing 1.

As shown in FIG. 2, the toner hopper 3 has an outer structural piece 12 with an opening 13 in it to allow the plastic bushing 1 to pass through. A hollow cylindrical extension 14 on the side wall 15 of the toner hopper 3 guides the bushing 1 as it is inserted through the wall 15. The hopper 3 includes a toner sensor bar 16 in the hopper interior. The sensor bar 16 is connected to an electrical contact on the imaging machine. By using electrical signals, the sensor bar 16 indicates to the imaging machine when there is no toner left in the hopper.

During insertion of the bushing 1 through the hopper wall 15, the spring-loaded prongs 6 are pressed down into the recesses 7 in the second part 5 until the prongs 6 are completely within the hopper 3. The spring-loaded prongs 6 snap outward and lock the bushing 1 in position on the wall 15 of the hopper 3. The felt gasket 11 is pinched and compressed between the outside of the hopper wall 15 and the first part 4 of the plastic bushing 1. The felt gasket 11 is used to prevent leakage of toner from inside the sealed toner hopper 3 to outside the hopper 3 at the location where the bushing 1 extends through the hopper wall 15.

The metal stir-rod 2 has an L-shaped end 17 which fits through one of the openings 10 and snugly into the cavity 9 of the cylindrical portion 8 within the second part 5 of the plastic bushing 1. The other end (not shown) of the stir-rod 2 is also L-shaped but simply fits into an aperture in the opposite wall of the hopper 3. The plastic bushing 1 rotates the stir-rod 2. The bushing 1 is turned or driven by mechanical sources outside the enclosed toner hopper 3. A drive motor within the printer, copier or facsimile machine turns the cartridge photoreceptor drum. From this, a gear-train within the cartridge assembly eventually drives the developer roller and turns the bushing 1. When the plastic bushing 1 is driven, the perimeter of the opening 10 in the second part 5 of the bushing 1 in contact with the L-shaped end 17 of the stir-rod 2 applies a force which rotates the stir-rod 2.

The felt gasket 11 by itself fails to prevent toner leakage after the cartridge assembly prints two thousand to eight thousand pages. The felt gasket 11 compresses over time, and becomes thinner. An associated problem occurs with the stir-rod 2. A torque is placed on the metal stir-rod 2 by the plastic bushing 1 as they each rotate. When the felt gasket 11 become inelastically compressed (in other words, the gasket 11 loosens), the bushing 1 may wobble as it is driven because the function of the gasket 11 to allow a good even mechanical rotation on a central axis of the bushing 1 fails after the felt gasket 11 compresses. Every so often, the torque in conjunction with the bushing wobble places a stress on the stir-rod 2, causing the stir-rod 2 to warp or curve temporarily. As the stir-rod warps for a brief moment, the L-shaped end 17 pulls slightly out of the bushing 1. A small amount of toner may then get inside the cavity 9 of the cylindrical portion 8 within the second part 5 of the bushing 1. This toner gets compacted and compressed when the stir-rod 2, due to its spring-resiliency, returns to its original position. As this event repeats itself through many cycles of the cartridge operation, the compacted toner builds up and puts an additional stress on the stir-rod 2. The stir-rod 2 eventually might warp permanently, affecting its performance. The curvature of the stir-rod 2 can become so pronounced that it contacts the sensor bar 16 and stops rotating. This can damage the gear-box, cartridge components and/or the imaging machine.

The stir-rod 2 warpage also has an impact on the toner leakage problem through the plastic bushing 1 when the felt gasket 11 compresses. When toner compacts within the bushing 1 and the stir-rod 2 warps, a greater force is exerted on the bushing. This places an even greater compressive force on the gasket 11. As the gasket 11 compresses even more, the stir-rod 2 loosens within the bushing 1. This additional play allows the stir-rod 2 to move back and forth within the cavity 9 in the cylindrical portion 8 in the bushing 1 as the bushing 1 rotates, creating a greater likelihood of toner compaction within the cavity 9. The problems feed on each other, providing more chances for the gasket 11 to irreparably compress or deteriorate and the stir-rod 2 to warp and the toner hopper to leak.

Figure 3:
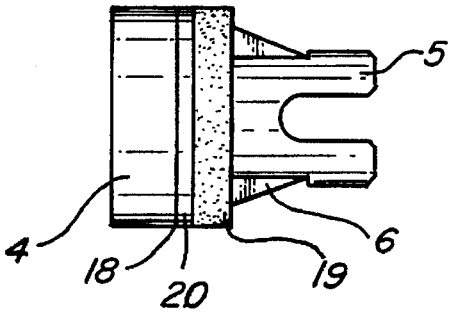
FIG. 3 shows a first embodiment of the improved gasket of this invention.

An improved gasket has been developed to prevent these problems. FIG. 3 shows a plastic bushing 1 with a gasket 18 comprising a laminate of crush-resistant material 19 and resilient material 20. A specific example would be a crush-resistant polyester or velvet laminated with a foam tape. The foam or foam tape would provide the resiliency. Another version would use a new layer of crush-resistant felt and foam tape. The gasket 18 has a longer usable life than the plain felt gasket 11, and could be produced at low cost. A piece of this laminate of crush-resistant material 19 and resilient material 20 of correct thickness would be stamped to the correct inside and outside diameters. Also, a foam or foam-type gasket may be used with a metal or plastic shim. When the crush-resistant material (velvet, polyester, or felt) inelastically compresses, the resilient material 20 then kicks in by using its memory to fill in where the other material compressed, filling in the void, thus making a longer-lasting seal.

Figure 4:
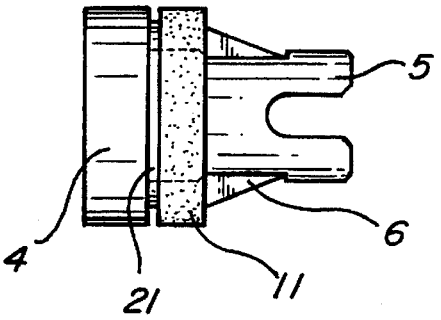
FIG. 4 shows a second embodiment of the improved gasket of this invention.

FIG. 4 shows a second embodiment of the invention. A circular shim 21 made of plastic, rubber, metal, steel, aluminun, brass, bronze, cardboard, paperboard, ceramic, glass, fiberglass, neoprene, polyurethane, urethane rubber, rubber, DELRIN, NYLON, TEFLON, polycarbonate, polyester, PETG or similar crush-resistant material is used to space the original felt gasket 11 (or a replacement felt gasket) from the first part 4 of the plastic bushing 1 to form a better seal. It has been found that a steel shim 21 having a thickness of forty-two thousandths of an inch plus or minus three thousandths of an inch works very well and is very inexpensive to manufacture. Actually it may range from 10 thousands to 60 thounsands. The shim 21 has an inside diameter slightly larger than the outside diameter of the second part 5 of the bushing 1, and an outside diameter large enough to provide an adequate surface contact area between the shim 21 and gasket 11. Actually, the ID of the shim 21 should be greater than or equal to the size of the plastic shaft it fits over. The outside diameter of the shim 21 may be sightly smaller than or equal to that of the outside diameter of the first part 4 of the bushing 1 to ensure the shim 21 does not interfere with insertion of the bushing 1 through the hollow cylindrical extension 14 on the side wall 15 of the toner hopper 3. Similarly the inside diameter should be largeer than the diameter of the shaft.

FIG. 5 demonstrates how the bushing 1 is first assembled with the shim 21 and gasket 11, then pushed through the opening 13 in the outer structural piece 12 of the hopper 3, and, finally, inserted through the hollow cylinderical extension 14 in the wall 15 of the toner hopper 3 into connection with the L-shaped end 17 of the stir-rod 2. The improved gasket 18 would be used in the same manner, replacing the shim 21 and gasket 11. FIG. 6 illustrates the completed connection. The shim 21 further compresses the felt gasket 11.

The shim 21, by being made of unresilient crush-resistant material, forces the gasket 11 to fit tighter against the wall 15 of the toner hopper 3. It also ensures that the bushing 1 does not loosen in its mount on the side wall 15 of the toner hopper 5, so the bushing will not wobble. The improved gasket 18 works in substantially the same way, but the crush-resistant material 19 provides the seal and spacing while the resilient foam material 20 provides some resiliency. The advantage of using the shim 21 is that it is less expensive and longer-lasting, so it is more practical. But with either embodiment, play in the stir-rod 2 is reduced, thereby preventing toner from getting into the cavity 9 in the cylinderical portion 8 which receives the end 17 of the stir-rod 2 in the bushing 1. As a result of using either of these embodiments, toner does not leak from the toner hopper 3 at the location of the plastic bushing 1 and stir-rod 2 warpage may be totally prevented.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents to the claimed elements.

What is claimed is:

1. An improved gasket for a bushing of the type including a base member, a body member supported by the base member and extending perpendicularly therefrom, the body member including an outer surface and an inner cavity, the body member including a hollow cylindrical member disposed within the inner cavity and supported by the base member for engaging a toner stir rod, the body member including locking means for securely retaining the bushing within an opening in a toner hopper, wherein the bushing drives the toner stir-rod within the toner hopper of a cartridge assembly for printers, copiers, and facsimile machines, said improved gasket including:

a first side surface for engaging the base member of the bushing and providing a tight seal thereagainst;

a second side surface for engaging the outer surface of a toner hopper assembly and providing a tight seal thereagainst;

a first layer of crush-resistant material; and a second layer of resilient material.

2. An improved gasket as in claim 1 wherein said crush-resistant material is a crush-resistant velvet.

3. An improved gasket as in claim 2 wherein said resilient material is foam tape.

4. An improved gasket as in claim 1 wherein said crush-resistant material is a crush-resistant felt.

5. An improved gasket as in claim 4 wherein said resilient material is foam tape.

6. An improved gasket as in claim 1 wherein said resilient material is foam tape.

7. An improved gasket as in claim 1 wherein said first layer of crush-resistant material is an incompressible shim and said second layer of resilient material is a felt gasket.

8. An improved gasket as in claim 7 wherein said incompressible shim is plastic.

9. An improved gasket as in claim 7 wherein said incompressible shim is metal.

10. An improved gasket as in claim 7 wherein said incompressible shim has a thickness of forty-two thousandths of an inch plus or minus three thousandths of an inch.

11. A bushing for use in a toner cartridge assembly comprising:

a base member;

a body member supported by said base member and extending perpendicularly therefrom;

said body member including an outer surface and an inner cavity;

said body member including a hollow cylindrical member disposed within said inner cavity and supported by said base member for engaging an end of a toner stir rod;

said body member including locking means for securely retaining said bushing within an opening in a toner hopper;

a gasket assembly disposed on said body member adjacent said base member; and said gasket assembly comprising a first layer of crush-resistant material and a second layer of resilient material.

12. A bushing as set forth in claim 11 wherein said crush-resistant material is a crush-resistant velvet.

13. A bushing as set forth in claim 11 wherein said resilient material is foam tape.

14. A bushing as set forth in claim 11 wherein said crush-resistant material is a crush-resistant felt.

15. A bushing as set forth in claim 11 wherein said first layer of crush-resistant material comprises an incompressible shim and said second layer of resilient material comprises a felt gasket.

16. A bushing as set forth in claim 15 wherein said incompressible shim is made from plastic.

17. A bushing as set forth in claim 15 wherein said incompressible shim is made from metal.

18. A bushing as set forth in claim 15 wherein said incompressible shim has a thickness of forty-two thousandths of an inch plus or minus three thousandths of an inch.

19. A toner cartridge assembly comprising:

a toner hopper including an inner wall defining a toner-holding compartment;

said toner hopper including an outer wall including an opening therethrough in fluid communication with said toner-holding compartment;

a stir rod supported for rotation by said toner hopper and disposed within said toner-holding compartment;

a bushing disposed within said opening of said toner hopper;

said bushing including a base member and a body member supported by said base member and extending perpendicularly therefrom;

said body member including an outer surface, an inner cavity, and a hollow cylindrical member disposed within said inner cavity and supported by said base member in engagement with an end of said toner stir rod;

said body member including locking means for securely retaining said bushing within said opening in said toner hopper;

a gasket assembly disposed on said body member of said bushing between said base member and said outer wall of said toner hopper; and said gasket assembly comprising a first layer of crush-resistant material and a second layer of resilient material.

20. A method for improving the seal between a bushing and toner hopper of a toner cartridge assembly, the toner hopper being of the type including an inner wall defining a toner-holding compartment, an outer wall including an opening therethrough in fluid communication with the toner-holding compartment, and a stir rod supported by the toner hopper and disposed within the toner-holding compartment; the bushing being of the type including a body member supported by a base member and extending perpendicularly therefrom, the body member including an outer surface, an inner cavity, and a hollow cylindrical member disposed within the inner cavity and supported by the base member, the cylindrical member being in engagement with an end of the toner stir rod, the body member including locking means for securely retaining the bushing within the opening in the toner hopper; the seal being a felt gasket which is pinched between the base member and the outer wall of the toner hopper, said method comprising the steps of:

removing the bushing from the opening in the toner hopper;

removing the felt gasket from the bushing;

replacing the felt gasket with a laminate of crush-resistant material and resilient material; and reinserting the bushing within the opening in the toner hopper.

21. A method as in claim 20 wherein said laminate is oriented such that said resilient material is between said first part of said bushing and said crush-resistant material.

22. A method as in claim 20 wherein said crush-resistant material is crush-resistant velvet and said resilient material is foam tape.

23. A method as in claim 20 wherein said crush-resistant material is crush-resistant felt and said resilient material is foam tape.

24. A method for improving the seal between a bushing and toner hopper of a toner cartridge assembly, the toner hopper being of the type including an inner wall defining a toner-holding compartment, an outer wall including an opening therethrough in fluid communication with the toner-holding compartment, and a stir rod supported by the toner hopper and disposed within the toner-holding compartment; the bushing being of the type including a body member supported by a base member and extending perpendicularly therefrom, the body member including an outer surface, an inner cavity, and a hollow cylindrical member disposed within the inner cavity and supported by the base member in engagement with an end of the toner stir rod, the body member including locking means for securely retaining the bushing within the opening in the toner hopper; the seal being a felt gasket which is pinched between the base member and the outer wall of the toner hopper, said method comprising the steps of:

removing the bushing from the opening in the toner hopper;

removing the felt gasket from the bushing;

placing an incompressible shim on the body member of the bushing adjacent the base member of the bushing;

reinstalling the felt gasket on the body member after said step of placing the incompressible shim on the body member; and reinserting the bushing within the opening in the toner hopper.

25. A method as in claim 24 wherein said incompressible shim has a thickness of forty-two thousandths of an inch plus or minus three thousandths of an inch.

26. A method as in claim 24 wherein said shim is plastic.

27. A method as in claim 24 wherein said shim is metal.

28. A method as in claim 27 wherein said metal is steel.

* * * * *